United States Patent [19]

Aoyama

[11] 4,183,333

[45] Jan. 15, 1980

[54] EGR CONTROL SYSTEM

[75] Inventor: Syunichi Aoyama, Yokohama, Japan

[73] Assignee: Nissan Motor Company, Limited, Japan

[21] Appl. No.: 913,037

[22] Filed: Jun. 7, 1978

[30] Foreign Application Priority Data

Jun. 27, 1977 [JP] Japan ..... 52/83612[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,013,052 | 3/1977 | Masaki et al. | 123/119 A |
| 4,041,917 | 8/1977 | Suzuki | 123/119 A |
| 4,056,084 | 11/1977 | Baumgartner | 123/119 A |
| 4,069,797 | 1/1978 | Nohira et al. | 123/119 A |
| 4,090,482 | 5/1978 | Yoshida | 123/119 A |
| 4,092,960 | 6/1978 | Nohira et al. | 123/119 A |
| 4,094,287 | 6/1978 | Nohira | 123/119 A |
| 4,124,004 | 11/1978 | Aoyama | 123/119 A |
| 4,128,090 | 12/1978 | Aoyama | 123/119 A |
| 4,130,093 | 12/1978 | Aoyama | 123/119 A |

*Primary Examiner*—Wendell E. Burns

*Attorney, Agent, or Firm*—Robert E. Burns; Emmanuel J. Lobato; Bruce L. Adams

[57] ABSTRACT

An EGR control system consists of a pressure regulating valve assembly which functions to prepare a control vacuum for an EGR control valve in accordance with the relationship between venturi vacuum and the pressure in a particular part of an EGR passageway connecting an exhaust gas passageway to an intake passageway. A connecting passage connecting the particular part of the EGR passageway to the pressure regulating valve assembly is provided with a flow restricting orifice therein. The connecting passage is further provided with a check valve to induct atmospheric air into the connecting passage to clean up the flow restricting orifice.

11 Claims, 1 Drawing Figure

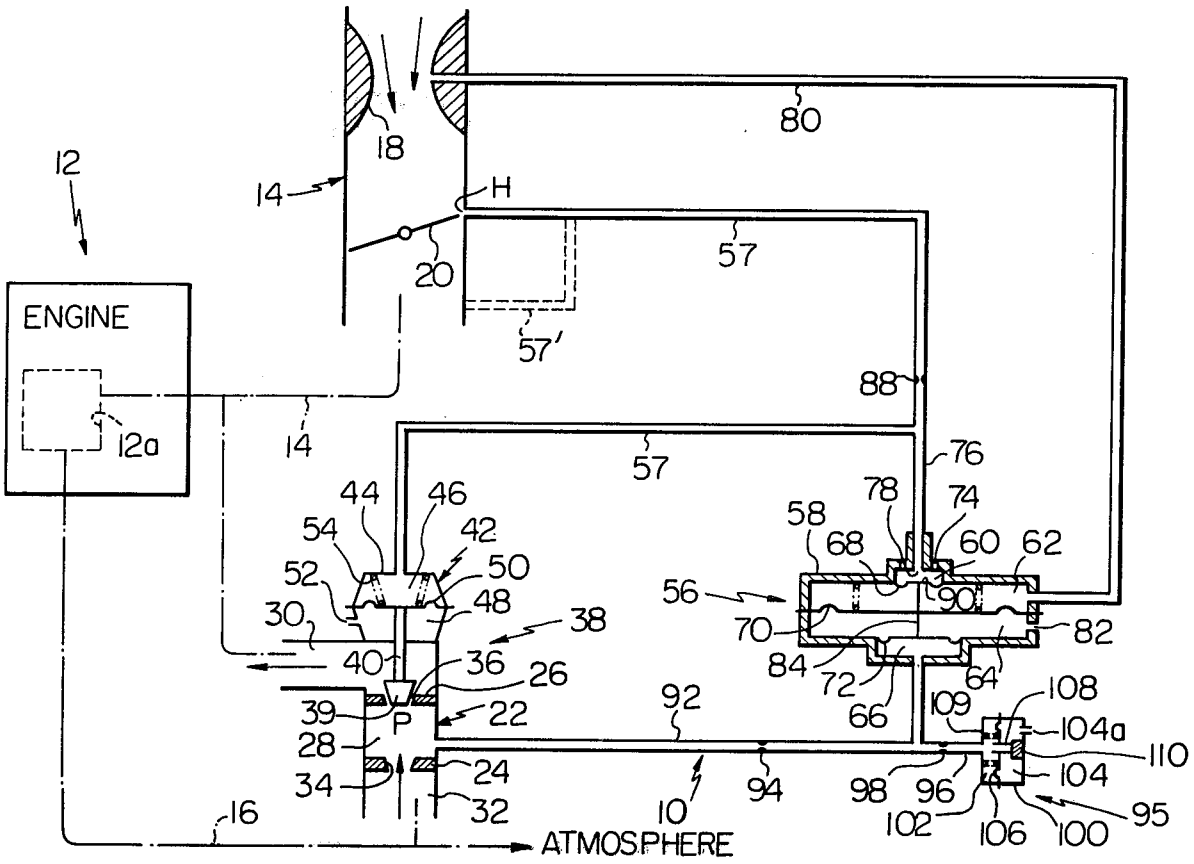
ENGINE
ATMOSPHERE
12
12a
14
16
18
20
22
24
26
28
30
32
34
36
38
39
40
42
44
46
48
50
52
54
56
57
57'
58
60
62
64
66
68
70
72
74
76
78
80
82
84
88
90
92
94
95
96
98
100
102
104
104a
106
108
109
110
10
H
P

EGR CONTROL SYSTEM

BACKGROUND OF THE INVENTION

This invention relates to an improvement in a EGR (Exhaust Gas Recirculation) control system for controlling recirculating a part of the exhaust gases passing through the exhaust gas passageway of an internal combustion engine back to the combustion chambers of the same.

It is well known in the art that a part of the exhaust gases of an internal combustion engine is recirculated back to the combustion chambers of the engine in order to suppress the maximum temperature of the combustion taken place in the combustion chambers to reduce the emission level of nitrogen oxides (NOx) generated during the combustion in the combustion chambers. By virtue of this exhaust gas recirculation, the NOx emission level has thus effectively been lowered. However, the recirculated exhaust gas greatly affects the combustion in the combustion chambers and stability of the engine. Therefore its amount is desired to be strictly controlled in consideration of vehicle driveability and fuel economy.

In this regard, it seems desirable to maintain constant EGR rate (the rate of the amount of recirculated exhaust gases with respect to the amount of intake air inducted to the engine). To meet this demand, the following EGR control system has been proposed by the same applicant as the present invention: an EGR control valve is operatively disposed in an EGR passageway downstream of a flow restricting orifice for regulating exhaust gas flow therethrough. The EGR control valve is controlled by a control vacuum which is made in a pressure regulating valve assembly. The pressure regulating valve assembly is constructed and arranged to dilute intake vacuum in an intake passageway for operating EGR control valve in accordance with the relationship between venturi vacuum and the EGR passageway between the EGR control valve and the flow restricting orifice.

By this EGR control system, the flow amount of recirculated exhaust gases is prevented from being affected by the variation of exhaust gas pressure. Accordingly, the recirculated exhaust gas amount can be controlled only in accordance with the venturi vacuum which is highly reliable as a function of the flow amount of the intake air conducted into the engine. This results in precise control of recirculated exhaust gases in accordance with intake air.

Now, the above-mentioned pressure regulating valve assembly is provided with a plurality of diaphragm members one of which communicates with the EGR passageway through a connecting passage. The connecting passage is provided thereinside with a flow restricting orifice for the purpose of lightening the action of exhaust gas pulsation to prevent the diaphragm from being damaged due to the exhaust pressure pulsation. However, such a flow restricting orifice in the connecting passage is, in general, has a small diameter and therefore it is liable to be clogged with foreign substances such as carbon particles in exhaust gases. Thus it is impossible to achieve precise control of exhaust gas recirculation.

SUMMARY OF THE INVENTION

It is the prime object of the present invention to provide an improved EGR control system, by which precise and desirable control of exhaust gas recirculation can be achieved even though foreign substances contained in exhaust gases are liable to clog a flow restricting orifice used in the EGR control system.

Another object of the present invention is to provide an improved EGR control system which is provided with valve means constructed and arranged to induct atmospheric air by the action of vacuum generated in a part of an EGR passageway connecting between an intake passageway and an exhaust gas passageway.

A further object of the present invention is to provide an improved EGR control system which is provided with a check valve in a connecting passage connecting between an EGR passageway and a pressure regulating valve assembly which functions to prepare a control vacuum for an EGR control valve by modifying an engine intake vacuum, through which check valve atmospheric air is inducted into the connecting passage when the pressure in the connecting passage is below atmospheric pressure, to blow off foreign substances such as carbon particles adhered to a flow restricting orifice formed in the connecting passage.

Other objects, features and advantages of the EGR control system according to the present invention will become more apparent from the following description taken in conjunction with the accompanying drawing.

BRIEF DESCRIPTION OF THE DRAWING

The single FIGURE is a schematic diagram of a preferred form of an EGR control system embodying the present invention.

DESCRIPTION OF THE PREFERRED EMBODIMENT

Referring now to the single FIGURE of the drawing, a preferred embodiment of an exhaust gas recirculation (EGR) control system 10 according to the present invention is shown as combined with an internal combustion engine 12 of a motor vehicle or an automobile. The engine 12 has, as usual, a combustion chamber **12*a* or combustion chambers therein. An air-fuel mixture from an air-fuel mixture supply device (not shown) is provided to the combustion chamber 12*a* through an intake passageway 14 which communicates the combustion chamber 12*a* with the atmosphere. The combustion chamber 12*a* is communicable with the atmosphere through an exhaust gas passageway 16 to discharge the exhaust gas from the combustion chamber 12*a* into the atmosphere therethrough. As shown, the intake passageway 14 is provided thereinside with a venturi 18. Rotatably disposed downstream of the venturi 18 is a throttle valve 20** which may form part of a carburetor as the air-fuel mixture supply device.

The EGR control system 10 is composed of an EGR passageway 22 providing communication between the exhaust gas passageway 16 and the intake passageway 14 downstream of the throttle valve 20 for recirculating or conducting engine exhaust gas into the intake passageway 14. The EGR passageway 22 is provided therein with partition members 24 and 26. The partition member 26 divides the EGR passageway 22 into an upstream part 28, 32 and downstream part 30. In the upstream part, a pressure chamber 28 is defined between the partition members 24 and 26. The partition member 24 is formed therethrough with an orifice 34 which provides communication between the upstream part 32 and the chamber 28, and forms together with the partition member 24 a flow restrictor of the EGR passageway 22 which controls the flow of recirculated engine exhaust gas. In this case, the diameter of the orifice 34 is about 9 mm. The partition member 26 or a valve seat is formed therethrough with an aperture or passage 36 which provides communication between the chamber 28 and the downstream part 30.

An EGR control valve assembly 38 is disposed such that its valve head 39 in the EGR passageway 22 is movable relative to the partition member 26. The valve head 39 is secured to a valve stem 40 extending therefrom externally of the EGR passageway 22. The EGR control valve assembly 38 includes a diaphragm unit 42 for operating the EGR control valve 38. The diaphragm unit 42 is composed of a housing 44 having first and second fluid chambers 46 and 48, and a flexible diaphragm 50 separating the fluid chambers 46 and 48 from each other. The fluid chamber 48 communicates through a hole 52 with the atmosphere. A spring 54 is provided to normally urge the diaphragm 50 in a direction to cause the valve head 39 to close the aperture 46. In this embodiment, the fluid chamber 46 of the diaphragm unit 42 communicates with the intake passageway 14 adjacent the throttle valve 20 through a passage 57 to receive a suction vacuum or intake vacuum in the passageway 14. The passage 57 opens adjacent the edge of the throttle valve 20 through a hole H which is located just upstream of the uppermost portion of the peripheral edge of the throttle valve at its fully closed position shown in the figure. The relative location of the hole H will be changed to the downstream side of the throttle valve 20 as the opening degree of the throttle valve 20 increases. Accordingly, the hole H is subjected to intake vacuum downstream of the throttle valve 20 after the throttle valve 20 is opened. The fluid chamber 46 may communicate with the intake passageway 14 downstream of the throttle valve 20 through another passage 57′ indicated in broken lines.

A pressure regulating valve assembly 56 is provided to regulate vacuum for operating the EGR control valve 38 in accordance with venturi vacuum and with the pressure P in the pressure chamber 28. The valve assembly 56 comprises a housing 58 having therein four chambers 60, 62, 64 and 66, and three flexible diaphragms 68, 70 and 72. The diaphragm 68 separates the chambers 60 and 62 from each other. The diaphragm 70 separates the chambers 62 and 64 from each other. The diaphragm 72 separates the chambers 64 and 66 from each other. The chamber 60 communicates with the atmosphere through an opening 74 and with the passage 57 through a passage 76 and an inlet port 78. The chamber 62 communicates with the venturi 18 through a passage 80. The chamber 64 communicates through an opening 82 with the atmosphere. The diaphragm 70 has a pressure sensitive surface area larger than that of each of the diaphragms 68 and 72. The diaphragms 68, 70 and 72 are fixedly connected to each other, for example, by means of a rod 84 so that they are operated integrally as one body. A spring 86 is provided to integrally urge the diaphragms 68, 70 and 72 in a direction opposed to the atmospheric pressure in the chamber 64. An orifice 88 is formed in the passage 57 on the intake passageway side of the junction to which the passage 76 is connected. A control valve head 90 is located in the chamber 60 movable relative to the port 78 to control the flow of atmospheric air through the port 78 and is fixedly secured to the diaphragm 68.

The chamber 66 communicates with the pressure chamber 28 of the EGR passageway 22 through a passage 92 which is provided thereinside a flow restrictor 94. This flow restrictor 94 functions to lighten the action of exhaust pressure pulsation acting on the diaphragm 72 to prevent the diaphragm 72 from being damaged due to the exhaust pressure pulsation. It is to be noted that since the orifice of the flow restrictor 94 is considerably small in diameter, for example, about 1.0 to 2.0 mm in diameter, it is liable to be clogged with foreign substances contained in exhaust gases such as carbon particles.

As shown, a check valve 95 fluidly connects through a passage 96 to the passage 92 between the restrictor 94 and the chamber 66 of the regulating valve assembly 56. The passage 96 is provided thereinside a flow restrictor 98 for restricting air flow therethrough. In this case, the orifice of the restrictor 98 is about 1.5 mm in diameter. The check valve 95 consists of a casing 100 which is divided into a vacuum chamber 102 and an atmospheric chamber 104 by a flexible diaphragm member 106 secured to the inner surface of the casing 100. The vacuum chamber 102 communicates through the passage 96 with the passage 92, whereas the atmospheric chamber 104 communicates with the atmosphere through an air inlet opening 104*a*. An air inlet member or pipe 108 is secured to the central portion of the diaphragm member 106 in such a manner that the longitudinal axis (not shown) thereof is generally perpendicular to the diaphragm member 106. A closing member or a contactable member 110 is secured to the casing defining the atmospheric chamber 104. The closing member 110 is located adjacent and contactable to one end of the air inlet pipe 108. A biasing spring 109 is disposed in the vacuum chamber 102 to normally urge the diaphragm member 106 in a direction to cause the air inlet pipe 108 to contact the closing member 110. The spring 109 is selected to be compressed to separate the air inlet pipe 108 from the closing member 110 when the pressure in the passage 92 is below a vacuum of a predetermined level such as about 20 mmAq. It will be understood that the communication between the passage 92 and the atmosphere is established to induct atmospheric air into the passage 92 when the air inlet pipe 108 separates from the closing member 110, whereas the same communication is blocked to interrupt air induction into the passage 92 when the air inlet pipe 108 contacts the closing member 110.

While the check valve 95 has been shown and described to be arranged to open to induct air into the passage 92, the check valve may be arranged to open even when the pressure in the passage 92 is slightly below atmospheric pressure, in which the diaphragm member 106 is selected to cause the air inlet pipe 108 to begin to separate from the closing member 110 on receiving a pressure which is slightly below atmospheric pressure.

Furthermore, although the check valve 95 has been shown and described to be connected to the passage 92 between the pressure regulating valve assembly 56 and the flow restrictor 94, it is also effective for obtaining the effect by the present invention that the check valve 95 is fluidly connected to the passage 92 between the flow restrictor 94 and the EGR passageway 22.

The operation of the thus arranged EGR control system 10 will be discussed hereinafter.

The venturi vacuum generated at the venturi 18 increases with the increase in the amount of intake air supplied to the combustion chamber 12a through the intake passageway 14 since the venturi vacuum is exactly in proportion to the square of the amount of the intake air, assuming the density of air and temperature are constant. Now, when the amount of the intake air slightly increases over that in a certain state, the venturi vacuum gradually increases. Accordingly, the diaphragms 68, 70 and 72 are integrally moved so that the valve head 90 reduces the degree of opening of the port 78 to reduce the flow of atmospheric air admitted into the passageway 76 and therefore the degree of dilution of the suction vacuum conducted into the chamber 46 is reduced. As a result, the degree of opening of the EGR control valve 38 is increased to increase the amount of exhaust gases recirculated into the combustion chamber 12a of the engine. This reduces the pressure P in the chamber 28 to reduce the pressure in the chamber 66 of the valve assembly 56. This decrease in the pressure P moves the diaphragms 68, 70 and 72 integrally to increase the degree of opening of the control valve with head 90 to the port 78 to increase the flow of atmospheric air admitted into the passage 76. Hence, the dilution of the suction vacuum by the atmospheric air is increased to reduce the degree of opening of the EGR control valve 38 to increase the pressure P in the chamber 28.

On the contrary, when the venturi vacuum decreases with decrease of intake air amount, the degree of dilution of the suction vacuum conducted into the chamber 46 is increased and accordingly the degree of opening of the EGR control valve 38 is decreased to decrease the amount of exhaust gases recirculated into the combustion chamber 12a of the engine. This increases the pressure P to increase the pressure in the chamber 66 of the valve assembly 56. As a result, the dilution of the suction vacuum by the atmospheric air is decreased to increase the degree of the opening of the EGR control valve 38 to reduce the pressure P in the chamber 28. By the repetition of such operations the pressure P and the degree of opening of the EGR control valve 38 are converged respectively to values in which the pressure P is balanced with the venturi vacuum to increase and reduce the recirculated exhaust gas flow accurately in accordance with the increases and decreases in the venturi vacuum.

With the above-mentioned controls, even if the intake vacuum applied to the diaphragm 50 of the EGR control valve assembly 38 varies with the variation of engine load, the amount of recirculated exhaust gas is maintained constant as far as the same magnitude of the vacuum signal generated at the venturi 18 is supplied to the chamber 62 of the regulating valve assembly 56. Additionally, the pressure P is not affected by the intake vacuum at the downstream portion 30 of the EGR passageway 22, even if the intake vacuum in the downstream portion 30 varies.

Furthermore, when the pressure P in the chamber 28 is varied regardless of the venturi vacuum by variations in the suction vacuum, the EGR control valve 38 is operated to cancel the variations in the pressure P by the pressure regulating valve assembly 56. In this instance, the pressure P is set to vacuum or negative pressure. Hence, when the negative pressure increases, the diaphragms 68, 70 and 74 are integrally moved to increase the degree of opening of the control valve with head 90 to the port 78. As a result, the degree of opening of the EGR control valve 38 is reduced similarly as mentioned above to reduce the influence of the suction vacuum on the pressure P to restore same to an initial value to prevent the recirculated exhaust gas flow from being varied irrespective of the venturi vacuum.

It will be appreciated from the foregoing that the pressure P can be controlled to a predetermined level and therefore the recirculated exhaust gas flow can be varied only as a function of the venturi vacuum generated at the venturi of the intake passageway.

Now, when the vacuum in the passage 92 exceeds the predetermined level, i.e., the absolute value of the vacuum becomes higher than that of the predetermined value, the air inlet pipe 108 of the check valve 95 separates from the closing member 110 to induct atmospheric air through the opening formed in the air inlet pipe 108 into the vacuum chamber 102. This atmospheric air passes through the passage 96 and is supplied to the passage 92. Then, the atmospheric air flows through the passage 92 toward the EGR passageway 22, passing through the restrictor 94. It is to be noted that when the air passes through the orifice of restrictor 94, the air flow blows off foreign substances adhered to the orifice of the restrictor 94, clearing up the orifice. Moreover, exhaust gases containing noxious constituents are then pushed into the EGR passageway 22, contributing to noxious gas emission control. It will be understood that the flow amount of the atmospheric air inducted into the passage 92 is very small, i.e., about 1/100 of the flow amount of recirculated exhaust gases as seen from the relationship between the diameters of the orifice of the restrictor 98 adjacent the check valve 95 and of the orifice of the restrictor 34 in the EGR passageway 22. Therefore, the infection of the inducted atmospheric air to NOx emission control is negligible.

During urban area cruising of the vehicle on which the engine 12 is mounted, in which exhaust gas recirculation is particularly desired, the vacuum in the passage 92 is weakened below the predetermined level, i.e., the absolute value of the vacuum becomes lower than that of the predetermined level. In this state, the air inlet pipe 108 of the check valve 94 urgingly contacts the closing member 110 to stop air induction to the vacuum chamber 102 of the check valve 95. As a result, the pressure P in the pressure chamber 28 is prevented from being changed to make certain the control of the exhaust gas recirculation, preventing exhaust gases from discharging into the atmosphere.

While only a particular type of check valve 95 has been shown and described as valve means for inducting atmospheric air into the passage 92 when the pressure in the passage 92 is below atmospheric pressure, it will be understood that the check valve 95 may be replaced with other check valves, for example, of a reed type wherein a flexible valve leaf is used, and of a ball type wherein a ball is normally urged to close an opening through which air is inducted.

Additionally, although the air inlet opening 104a of the check valve 95 has been shown to be opened to the atmosphere, the air inlet opening 104a may communicate with the atmosphere through a filter media (not shown) of an air filter for filtering intake air inducted into the engine, or connected with the intake passageway downstream of the air filter.

What is claimed is:

1. An exhaust gas recirculation (EGR) control system in combination with an internal combustion engine including a combustion chamber, an intake passageway providing communication between the atmosphere and the combustion chamber, a venturi formed in the intake passageway, a throttle valve rotatably disposed in the intake passageway downstream of the venturi, and an exhaust gas passageway providing communication between the combustion chamber and the atmosphere, said EGR control system comprising:

EGR passageway means providing communication between the exhaust gas passageway and the intake passageway to recirculate exhaust gas back to the combustion chamber, said EGR passage means being provided thereinside with a first flow restrictor;

a diaphragm operated EGR control valve operatively disposed in said EGR passageway means downstream of said first flow restrictor to define a pressure chamber between said EGR control valve and said first flow restrictor, the diaphragm of said EGR control valve defining a first chamber which communicates through first passage means with the intake passageway to provide the first chamber with intake vacuum in the intake passageway, said EGR control valve being operative in accordance with the intake vacuum to control the pressure of the exhaust gas in the upstream part of said EGR passageway means to control the flow of the recirculated exhaust gas;

regulating means for regulating the intake vacuum to be provided to the first chamber of said EGR control valve in accordance with the exhaust gas pressure in the upstream part and in accordance with the vacuum in the venturi, said regulating means including second passage means connecting to said first passage means and having an inlet port communicating with the atmosphere, a pressure regulating valve head movable relative to said inlet port of said second passage means for controlling the flow of atmospheric air bled through said inlet port into said second passage means, first and second flexible diaphragms defining, respectively, a second chamber communicating with said venturi and a third chamber communicating through third passage means with the pressure chamber of said EGR passageway means, said first and second flexible diaphragms operatively connect to each other and being operatively connected to said pressure regulating valve head to operate said pressure regulating valve head in response to the pressures in said second and third chambers;

a second flow restrictor formed in the third passage means to prevent said second flexible diaphragm from being damaged by exhaust pressure pulsation transmitted from said EGR passageway; and valve means for inducting atmospheric air into the third passage means when the pressure in the third passage means is below atmospheric pressure.

2. An EGR control system as claimed in claim 1, in which said valve means is a check valve fluidly connected to the third passage means, said check valve being arranged to open to induct atmospheric air into the third passage means when the pressure in the third passage means is below atmospheric pressure.

3. An EGR control system as claimed in claim 2, in which said check valve includes a diaphragm member defining a vacuum chamber which communicates with the third passage means, an air inlet member secured to said diaphragm member and having an opening through which the vacuum chamber is communicable with the atmosphere, a closing member securely disposed adjacent said air inlet member and contactable to said air inlet member to open and close the opening of said air inlet member, and an urging spring disposed in the vacuum chamber to urge said diaphragm member in a direction to cause said air inlet member to contact said closing member.

4. An EGR control system as claimed in claim 3, further comprising fourth passage means fluidly connecting the vacuum chamber of said check valve to the third passage means, said fourth passage means being provided thereinside with a third flow restrictor.

5. An EGR control system as claimed in claim 2, in which said check valve is fluidly connected to the third passage means between the second flow restrictor and the third member formed in said regulating means.

6. An EGR control system as claimed in claim 3, in which said urging spring is selected to be compressed to separate said air inlet member from said closing member to open the opening of the air inlet member when the pressure in the third passage means is below a predetermined level.

7. An EGR control system as claimed in claim 6, in which said predetermined level of the pressure is a vacuum of 20 mmAq.

8. An EGR control system as claimed in claim 3, in which said check valve means further includes a casing which is divided by said diaphragm member into the vacuum chamber and an atmospheric chamber which communicates with the atmosphere, said closing member being secured to said casing defining the atmospheric chamber.

9. An EGR control system as claimed in claim 8, in which said air inlet member is a pipe member having a cylindrical opening along the longitudinal axis thereof, said pipe member is secured to the central portion of said diaphragm member and such located that the longitudinal axis thereof is generally perpendicular to said diaphragm member.

10. An EGR control system as claimed in claim 9, in which said closing member is located generally parallelly with said diaphragm member.

11. An EGR control system as claimed in claim 1, in which said second flow restrictor is an orifice having a diameter ranging from 1.0 to 2.0 mm.

* * * * *